US005839996A

United States Patent [19]

Gooding

[11] Patent Number: 5,839,996

[45] Date of Patent: Nov. 24, 1998

[54] DEVICE FOR PERFORMING EXERCISES

[76] Inventor: Uriah Ray Gooding, 1816 Northcliff Dr., Charlotte, N.C. 28216

[21] Appl. No.: 797,934

[22] Filed: Feb. 12, 1997

[51] Int. Cl.[6] ..... A63B 21/06

[52] U.S. Cl. ..... 482/106; 482/93; 482/107

[58] Field of Search ..... 482/93, 74, 105–109; 473/256, 437, 519

[56] References Cited

U.S. PATENT DOCUMENTS 4,440,391 4/1984 Saenz, Jr. et al. ..... 482/106 X 5,393,285 2/1995 Fischer, Sr. et al. ..... 482/106 X

*Primary Examiner*—Richard J. Apley

*Assistant Examiner*—John Mulcahy

[57] ABSTRACT

An exercise device including a tubular pole having a central portion and two end portions, the central portion having a gripping area and the two end portions capable of receiving releasably securable weights that may be adjusted to provide an exercising device of varying dynamics.

2 Claims, 1 Drawing Sheet

DEVICE FOR PERFORMING EXERCISES

BACKGROUND OF THE INVENTION

1. Field of the Invention

This invention relates to a device for exercising the human torso and more particularly to an exercising device wherein the spacing of weights along certain lengths of a tubular pole may be selectively varied to accommodate people of different sizes and energy capabilities.

2. Description of the Prior Art

Exercise continues to enjoy ever increasing popularity among people of all ages, both men and women, girls and boys, and at home and in health centers and gymnasiums. There are literally thousands of types of exercising and weight lifting devices on the market today, but by far the most widely used is the barbell combination in one form or another.

Today's exercisers use devices to keep the body in shape and maintain muscle tone without trying to develop the over-muscled physique previously associated with weight lifting. With people of all ages taking an interest in physical fitness, the trend has been to lighter, more flexible devices that can be used with a routine of body motions and movements and in combination with other mechanical devices to achieve an overall body workout. Moreover, there is a need for maximum safety in today's exercising equipment even when the exercising devices are not unseemingly heavy or awkward to handle.

Walking has been proven to be one of the most effective forms of exercise and a favorite activity of people of all ages. The provision of a supplemental exercise device to enhance and complement this already widely used form of exercise would provide the added benefits of an aerobic workout for the upper body and make the workout even more fun.

Examples of high repetition exercise devices that can be used with a body motion routine or in combination with other mechanical devices are shown in U.S. Pat. Nos. 2,528,213; 4,664,373; 4,743,016; and 5,334,118. While the devices shown in these references are capable of various uses and are to some extent adjustable for varying routines, there is still a need for other devices to accommodate specific needs of one or more groups of exercisers. It is to this need that the present invention is directed, utilizing lightweight, colorful and attractive materials in a variety of colors and sizes.

OBJECTIVES AND SUMMARY OF THE INVENTION

It is an objective of the present invention to provide an adjustable exercise device that can be utilized by people of varying skill and conditioning to accommodate a broad range of physical exercises.

It is another objective of the present invention to provide a bar having releasably securable adjustable collars selectively positioned on certain segments of a tubular pole.

Yet another objective of the present invention is to provide a device for performing exercises of the type described which has a gripping area centrally located between the tubular pole segments adapted to receive the releasably securable collars.

Yet still another objective of the present invention is to provide adjustable weights inside the removable collars which are safe and easy to use.

A further objective of the present invention is to provide an adjustable exercise device utilizing a bar or tubular member to which is attached encapsulating end portions suitably designed to retain varying amounts of weight.

To accomplish the objectives set forth above, an exercise device is provided that includes a tubular pole having a central gripping area and the two end portions capable of receiving releasably securable collars or weights that may be adjusted to provide an exercising device of varying dynamics.

Thus there has been outlined, rather broadly, the more important features of the invention in order that the detailed description that follows may be better understood and in order that the present contribution to the art may be better appreciated. There are obviously additional features of the invention that will be described hereinafter and which will form the subject matter of the claims appended hereto. In this respect, before explaining several embodiments of the invention in detail, it is to be understood that the invention is not limited in its application to the details of construction and to the arrangement of the components set forth in the following description or illustrated in the drawings. The invention is capable of other embodiments and of being practiced and carried out in various ways.

It is also to be understood that the phraseology and terminology herein are for the purpose of description and should not be regarded as limiting in any respect. Those skilled in the art will appreciate the concept upon which this disclosure is based and that it may readily be utilized as a basis for designing other structures, methods and systems for carrying out the several purposes of this development. It is important that the claims be regarded as including such equivalent constructions insofar as they do not depart from the spirit and scope of the present invention.

Thus, the enumerated objectives and others identified hereinafter along with the various features of novelty which characterize the invention, are pointed out with particularity in the claims annexed to and forming a part of this disclosure. For a better understanding of the invention, its operating advantages and the specific objects obtained by its use, reference should be made to the accompanying drawings forming a part of the specification in which like characters of reference designate like parts throughout the several views.

DESCRIPTION OF THE PREFERRED EMBODIMENT

Figure 1:
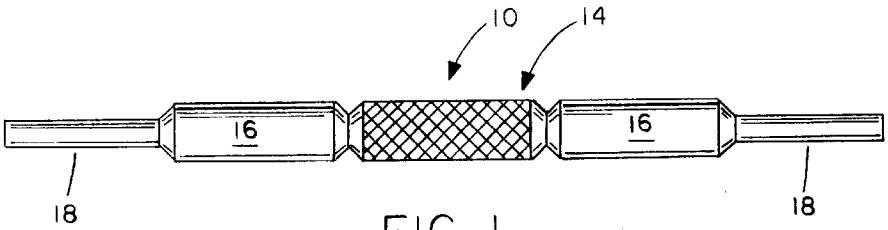
FIG. 1 is a plan view of the tubular pole of the present invention showing the central portion and the two end portions.
Figure 2:
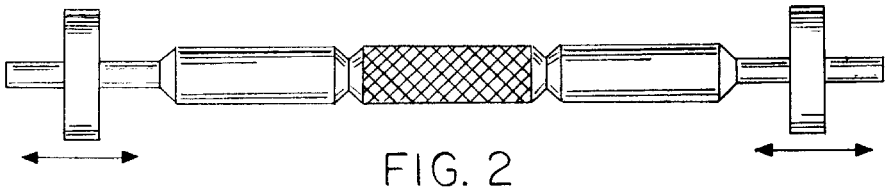
FIG. 2 is a plan view of the tubular pole shown in FIG. 1 on which is positioned two releasably securable and adjustable collars.

Referring now to the drawings and particularly to FIG. 1, the exercise device 10 comprising the present invention includes a tubular pole 12 which has a central portion 14, intermediate portions 16 and end portions 18. Recesses 17 form boundaries between central portions 14 and intermediate portions 16. The diameters of the various portions differ; the diameter of the central portion 14, and the diameter of the intermediate portions 16 are greater than the diameter of the end portions 18.

Central portion 14 has a gripping area which is knurled for ease of handling by the exerciser. While the length of the central portion may vary, it has been found comfortable and usually acceptable for the length to be within the range of 5–6 inches.

Intermediate portions 16 represent inactive portions of tubular rod 12 in that it is not usually gripped in these areas nor are they susceptible to receiving any additional components. They do usually represent the longest portion of tubular pole 12 usually having a length within the range of 10–13 inches.

Figure 3:
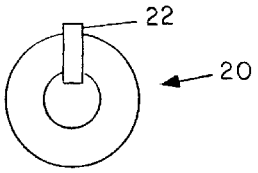
FIG. 3 is a side elevational view of a collar like those shown in FIG. 2.

End portions 18 have the smallest diameter of any of the pole portions and are usually the shortest in length, for the most part not exceeding the length of 4½ inches. End portions 18 cooperatively receive a releasably securable collar 20, the securability being achieved by an appropriate snap of frictionally engaging member 22 as shown in FIG. 3. While a length of 4½ inches is usually sufficient, there may be times, depending on the user's size and physical capabilities, when that dimension might be exceeded.

Collar 20 may be movable along the length of each end member to vary the dynamics of the device 10 as the exerciser using it moves through the various steps of any given routine. Moving the collars inwardly or outwardly along the length of the pole thus provides a different dynamic effect on the user even within the same exercise routine. Collars 20 may weigh from 1 to 2 ounces.

Figure 6:
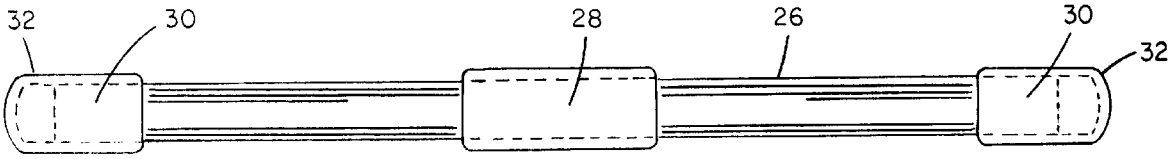
FIG. 6 is a plan view of another embodiment of the exercise device comprising the present invention having an encapsulated gripping portion and two end encapsulating members suitably designed to retain removable weights.
Figure 7:
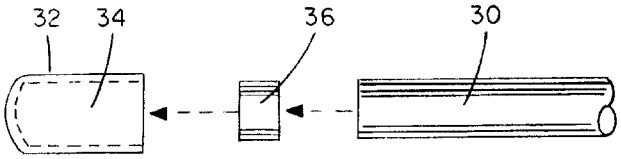
FIG. 7 is an enlarged, exploded and partial view of one end portion of the tubular member of the present invention showing the encapsulated end and its relationship with a removable weight and an end of the tubular member.

In another embodiment of the present invention (FIG. 6), a tubular pole 26, having a uniformly circular cross section, is encapsulated by a tubular sleeve 28 to form a gripping portion for the device. Each end 30 of pole 26 is covered by a non-spherical end encapsulating member 32 each having a uniformly circular cross section as shown. Members 32 are hollow, and each have a smooth cylindrical interior 34 with an interior diameter d (FIG. 7) and are adapted to cooperatively receive through an open end a weight 36 having a height h which is slightly less than diameter d so that the weight 36 is held entirely within interior 34 by a closed end when member 32 is positioned over end 30. Weight 36 may be varied as the user desires, presumably increased as the exerciser becomes more conditioned to the use of the device. Thus the outer diameter od of pole 26 is substantially the same as, but not greater than weight height h.

Members 32 can be frictionally and non-threadably held over ends 30 of pole 26; however, cooperating ridges on pole end 30 and the interior 34 of member 32 can be provided to latch member 32 in position over end 30 if desired.

Sleeve 28 and members 32 can be made of rather inexpensive plastic material suitably molded to conform to the size of the pole 26 being used. Use of such materials produces a low cost exercise device of great utility which can be varied in length and weight as desired.

Figure 4:
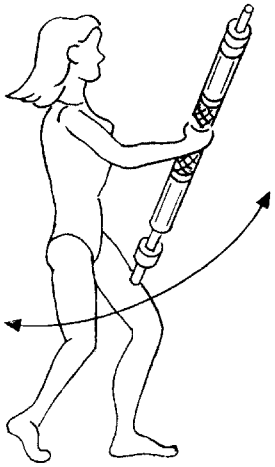
FIG. 4 is a side elevational view of an exerciser utilizing the exercise device comprising the present invention.

The present invention can be used as the exerciser walks or jogs or is stationary since it functions in response to arm movements to provide resistance and weight for specific body areas. For example, the bar can be moved from a lower to an upward position and downward again as shown in FIG. 4 for arms, shoulder and chest muscle toning exercises. While a single device may be used by an exerciser with one or both hands, two devices are usually used, one with each hand, to provide a balanced exercise routine.

Figure 5:
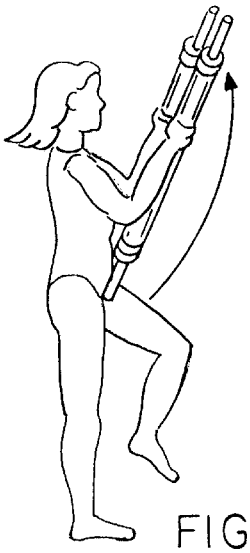
FIG. 5 is a side elevational view of an exerciser utilizing the device of the present invention in combination with a stepping mechanism.

Device 10 may also be used in combination with other units such as a stepper (FIG. 5) whereby a total body workout, including aerobic stimulation, may be accomplished.

While the invention has been particularly shown and described in reference to its preferred embodiment thereof, it will be understood by those skilled in the art that changes in form and details may be made therein without departing from the spirit and scope of the invention.

I claim:

1. A device for performing exercises, comprising: a tubular pole having a central portion, intermediate portions and two end portions, the end portions each having an outer diameter; a gripping sleeve encircling the tubular pole between the intermediate portions; and a non-spherical end encapsulating member having an interior diameter and an exterior diameter frictionally and non-threadably engaging each of the two end portions, each member having a smooth, cylindrical hollow interior, a closed end and an open end, the open end of each member encapsulating an end portion of the tubular pole; and a weight held entirely within each encapsulating member interior between the closed end of the encapsulating member and the end of the tubular pole, wherein the weight height is less than the end encapsulating member interior diameter.

2. The device as claimed in claim 1 wherein the pole outer diameter is substantially equal to but not greater than the weight height.

* * * * *